United States Patent [19]

St. Germain

[11] 4,043,581

[45] Aug. 23, 1977

[54] SLING CONSTRUCTION

[75] Inventor: Dennis St. Germain, Aston, Pa.

[73] Assignee: I & I Sling Co., Inc., Aston, Pa.

[21] Appl. No.: 672,470

[22] Filed: Mar. 31, 1976

[51] Int. Cl.[2] ..... B66C 1/18

[52] U.S. Cl. ..... 294/74; 57/142; 57/156

[58] Field of Search ..... 294/74, 75; 57/139, 57/141, 142, 158, 159, 156; 87/8

[56] References Cited

U.S. PATENT DOCUMENTS

| | | | |
|---|---|---|---|
| 2,082,828 | 6/1937 | Garris | 294/74 X |
| 2,199,958 | 5/1940 | Mazzella | 294/74 |
| 2,299,568 | 10/1942 | Dickey | 294/74 X |
| 2,325,261 | 7/1943 | Mazzella | 57/142 UX |
| 2,435,088 | 1/1948 | Mazzella | 87/8 |
| 3,067,570 | 12/1962 | Nischan | 57/142 |
| 3,079,192 | 2/1963 | Otley | 294/74 |
| 3,118,273 | 1/1964 | Lucht | 57/142 |
| 3,338,046 | 8/1967 | Baur et al. | 294/74 X |

*Primary Examiner*—Johnny D. Cherry
*Attorney, Agent, or Firm*—Anthony J. McNulty

[57] ABSTRACT

An improved sling construction is disclosed. The sling is formed or woven from a single cable in such a manner that it has a body having an eye at each end thereof. The body includes three parts or cable segments while each eye is formed by two sections or loops of the cable. Each eye includes one loop, made from a cable end section, which is a flemish eye and which has the end of the cable secured to one of the three body parts or cables by a pressed sleeve.

5 Claims, 4 Drawing Figures

SLING CONSTRUCTION

BACKGROUND OF THE INVENTION

1. Field of the Invention

This invention relates to a Sling Construction for hoisting slings and the like, made from wire rope, cable, or equivalents and to methods of making such slings. More specifically, the invention relates to a hoisting sling having eyes made of two loops, one of each loop in each eye being a flemish eye secured to a portion of the sling body by a pressed or swaged sleeve.

2. Description of the Prior Art

The prior art is replete with hoisting slings which have a body and an eye forming an integral portion of each end thereof. The prior art slings generally include a structure or method for forming the eye of the sling from the same cable or cables which form the body thereof. A sling construction of the above-described type is disclosed in U.S. Pat. No. 2,199,958 issued to Mazzella. Use of a flemish type eye in a sling is disclosed in U.S. Pat. No. 3,008,287 issued to Crandall.

SUMMARY OF THE INVENTION

Load carrying slings are ideally capable of carrying large loads and have great flexibility, particularly in the eye of the sling. It is highly desirable that all of this be accomplished with a sling having components of a minimum diameter. The ends of the wire ropes which make up the cables or parts of the sling must be secured either by weaving them into or with other wire ropes or by clamping them to other wire ropes. For slings which are used for high load carrying applications, clamping is almost always used although sometimes in combination with a weaving or interlocking of the ends.

The clamping of the ends of the cable has been accomplished through the use of metal sleeves. Typically in the prior art designs, a cable section forming an eye is double backed upon itself and secured with a sleeve compressing the cable end to other cable sections. These sleeves and the size of them are very significant in sling design in that they can add cost and weight to the resultant sling. Additionally, the sleeves are bulky and constitute a protuberance from the contour of the sling and as such frequently cause the sling to snag upon various objects, particularly the object being lifted or the hoisting mechanism.

In the preferred embodiment of the present invention, a sling is woven from a single continuous length of cable. The resultant sling has a three part body, or a body made of three cable sections, loosely woven or twisted together. An eye is formed at each end of the body of the sling. Each eye is woven from two loops of cable. One loop in each eye may be of the type known as a flemish eye, which will hereinafter be described in detail. The sling is woven so that an end of the cable is positioned at a juncture of the eye and body. The end of the cable is secured to only one of the three cable sections which form the body.

The resulting sling is very flexible, due to the loose weave of the cable making up the body and eyes. The cable ends are redundantly secured to the sling body through the use of the flemish eye and a sleeve. Costs and weight are kept to a minimum by securing the cable ends to only one of the three cable sections forming the body of the sling. The cost is reduced not only due to the fact that a smaller and therefore less expensive sleeve may be used but because that smaller sleeves require smaller presses or other force fitting equipment to secure the sleeve effectively to the body. The securing of the cable end to only one of the three sections making up the body also directly increases the flexibility of the sling as the eye formed by the two loops is freer to move with respect to the sling body than it otherwise would be if the end were secured to all three sections of cable making up the body of the sling.

Accordingly, it is an object of the present invention to provide a load carrying sling construction which is flexible.

it is an object of the present invention to provide a load carrying sling construction having a body made of three loosely woven cables, the entire sling being made from a single length of cable.

It is an additional object of the present invention to provide a load carrying sling made of a continuous length of cable wherein the end of the cable is secured to one of three cable sections forming the body of the sling.

It is still an additional object of the invention to provide a load carrying sling having an eye made of a pair of loops wherein one of the loops is a flemish eye which is secured to one of three cables forming the body of the sling.

Other objects and advantages of this invention will become apparent in the description which follows taken together with the accompanying drawings.

BRIEF DESCRIPTIONS OF THE DRAWINGS

DESCRIPTION OF THE PREFERRED EMBODIMENT OF THE INVENTION

Figure 1:
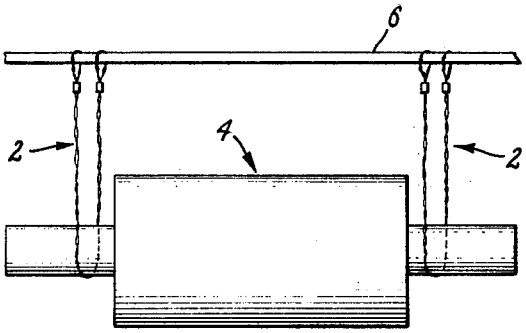
FIG. 1 is a perspective view of the sling construction of the present invention being used to support cargo.

Referring now to FIG. 1, a pair of slings 2, of the present invention, are shown supporting opposite ends of a load 4 thereby suspending it from a rod 6. This particular use of the invention is shown by way of example only and is not intended to limit the areas to which the invention may be applied. There are many other uses for a sling of the present invention which are well known to those skilled in the art.

Figure 2:
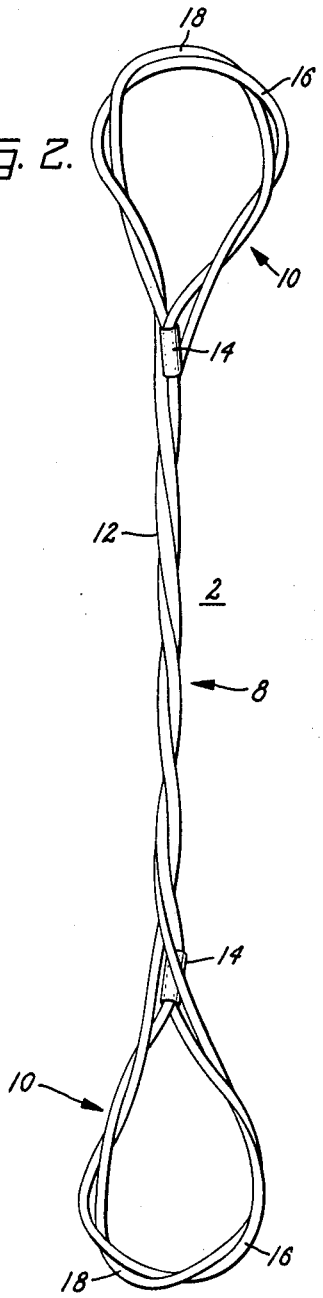
FIG. 2 is a plane view of the sling construction of the present invention.

The details of the sling 2 are shown in FIG. 2, the sling 2 has a body 8 and eyes 10. The entire sling 2 including the body 8 and the eyes 10 are made of one continuous length of cable 12. The two ends of the cable 12 are secured by sleeves 14 to portions of the cable 12 itself. The body 8 is made up of three sections of cable 12 or three "parts" as they are referred to by persons familiar with the art to which this invention pertains. Each eye 10 is made up of two loops 16 and 18 which are each formed, of course, by cable 12. Loop 18 is the closure loop and is the loop formed by cable 12 when an end 20 thereof is doubled back onto itself and secured by sleeve 14.

It is important to note that the sections of cable 12 in forming the body 8 of the sling are loosely woven together. It is equally important to note that the cable 12 is loosely woven in forming the loops 18 and 16 thus forming the eyes 10. This loose weaving of the cable 12 in forming the sling 2 contributes greatly to its flexibility.

The cable 12 may be of any material; however, in the preferred embodiment it is a multi-strand cable made from wire. Typically such cables are made having five or more strands. Of course, each strand itself may be made up of smaller elements such as filaments or wires. The particular materials from which the cable 12 is formed is not to be considered a limitation on the present invention. The type of material actually used will depend upon the particular purpose to which the sling is applied. In the embodiment of the invention discussed herein large and extremely heavy loads are to be carried, accordingly high strength steel wire is used.

Figure 3:
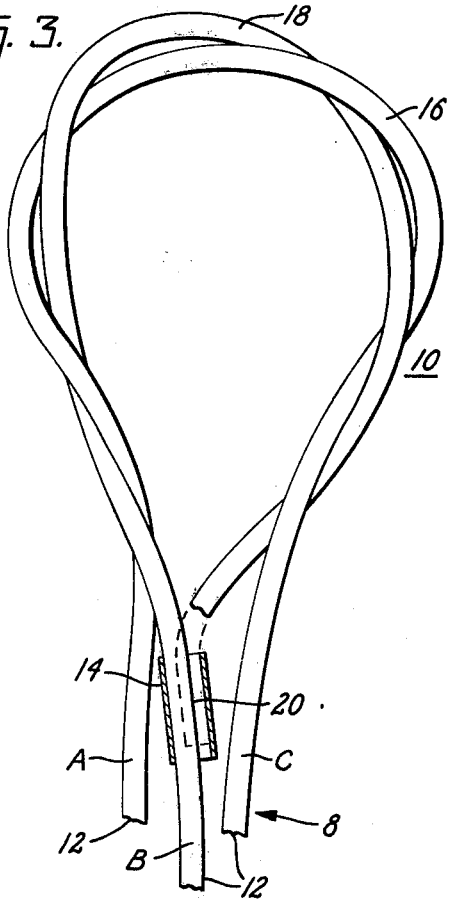
FIG. 3 is a plane view of one end of the sling construction of the present invention showing the manner in which the end of the cable is secured to one of the three cable sections forming the body of the sling.

Reference will now be made to FIG. 3 where the construction of an eye 10 is shown in greater detail. The body 8 of the cable is formed by three sections of cable 12 A, B and C. Closure loop 18 is formed by the cable 12 when the end thereof is doubled back upon itself and secured to cable section B by sleeve 14.

It is to be noted that the end 20 is secured to only one of the cable sections, section B, of the body 8. This has the advantage of enabling the sleeve 14 to be made much smaller thereby saving costs and weight. Another significant advantage is that greater flexibility of the eye and the body is obtained. Prior art constructions have secured the cable end to all the cable sections which make up the body of a sling as has been previously discussed.

Figure 4:
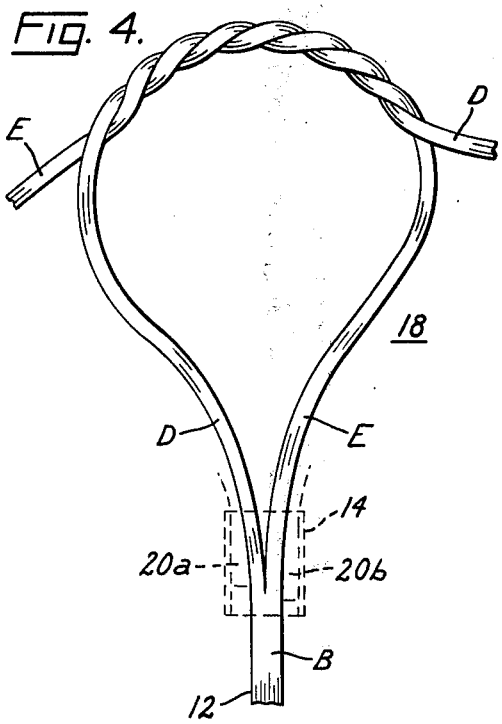
FIG. 4 is a plane view of a portion of an eye of the preferred embodiment of the present invention showing how an end of the cable is connected to one of three cable sections forming the body of the sling using a flemish eye construction.

In another embodiment of the invention the closure loop 18 is formed using a flemish eye or a loop of the flemish type. The loop 18 is shown schematically and partially completed, as a flemish eye in FIG. 4. This type of construction is well known in the field and will be briefly described for purposes of clarity. Cable 12 of section B of the body 8 is shown in FIG. 4. The strands comprising the cable 12 are unwound and separated into two groups, group D and group E. In cables having an even number of strands, groups D and E will have an equal number of strands; however, in cables having an unequal number of strands, one of the groups will have one more strand than the other. In forming the flemish eye each of the groups D and E is doubled back upon the other in opposite directions so as to form the loop 18. As shown in FIG. 4, in phantom, the ends 20*a* and 20*b* of each of the groups D and E respectively, are secured to the body part of section B of the body of the sling 8, in much the same manner as shown in FIG. 3 by the sleeve 14. The advantage of the flemish eye construction is that it makes the attachment of the end of the cable 12 to the body section B by the sleeve 14 redundant, and therefore makes the attachment more secure.

In forming a sling 2 of the present invention a length of cable is selected. A sleeve 14 is positioned on the cable. The end of the cable is then doubled back upon itself and inserted into the sleeve 14. Typically the sleeve 14 is made of metal. After the sleeve is positioned over the body of the cable and its end, it is swaged or pressed so that it compresses the strands of the end of the sling. The cable is then woven back toward the first end thus forming the second part of the body of the sling. The loop 16 at the first end of the sling is then formed. The third part of the body is then formed followed by the formation of the closure loop at the opposite or secured end of the sling. Prior to forming the final loop 18, a sleeve 14 is inserted over the end of the cable, loop 18 is formed and the end 20 is inserted into the sleeve. The final step, of course, is the swaging or pressing of the sleeve 14 to secure the end to the cable thus forming the final closure loop thereby completing the construction of the sling 2.

Numerous variations and modifications of the above-described invention will occur to those skilled in the art in light of this disclosure and the prior art. It is contemplated, therefore, that the present invention may be practiced otherwise than specifically described herein while remaining within the scope of the following claims which define the invention.

What is claimed is:

1. A sling for carrying loads which is made from a single length of cable, having ends thereof, which comprises: a body which includes three sections, loosely interwoven together, of said cable; a pair of loops formed from the cable, at each end of said body; wherein the loops of each pair are loosely woven together; wherein each pair of loops includes a first loop which is integrally connected to two of the three sections of cable forming said body and a closure loop; and wherein said closure loop is formed by the remaining section of the three sections of cable forming said body, doubled back upon, and secured to, itself only, by a metal sleeve which holds said end to said cable in a compressed relationship.

2. A sling for carrying loads, constructed from a single length of cable having first and second ends which comprises:

A body including a first section of cable, a second section and a third section of cable, loosely woven together;

A first eye including a first loop, loosely woven with a second loop, said first loop being formed by said first end of said cable which is an integral part of said first section, when said first end is doubled back upon itself and secured only to said first section thereby permitting relative movement between said first section, said second section, and said third section so as to permit greater ease in handling, said second loop being formed when said second section doubles back upon itself to become said third section; and A second eye formed by a third loop loosely woven with a fourth loop, said third loop being formed when said first section of said cable doubles back upon itself to become said second section, said fourth loop being formed when said second end of said cable which is an integral part of said third section is doubled back upon itself and secured only to said third section thereby permitting relative movement between said first, said second, and said third sections so as to permit greater ease in handling.

3. The sling of claim 2 wherein said first cable end is secured only to said first section of cable by a metal sleeve.

4. A method of forming a sling for carrying loads from a single length of cable which includes the following steps:

doubling a first end of the cable back upon itself to form a first closure loop at the first end of the sling, securing said end of the cable to the cable only by a sleeve, laying down a length of cable to form a first body part, doubling the cable back upon itself to form a first loop at the second end of the sling, laying a length of cable to form a second body part, doubling the cable back upon itself to form a second loop at the first end which in combination with said first closure loop forms an eye at the first end of the sling, laying a third length of cable to form a third body part, doubling the cable back upon itself to form a second closure loop at the second end of said sling so that the remaining second end of the cable is in contact with said third body part, so that said second closure loop in combination with said first loop forms an eye at said second end of the sling, and securing said second end of the cable to the third body part only.

5. The method of claim 4 wherein the said second end of the cable is secured only to the third body part by means of a sleeve.

* * * * *